US012697535B2

(12) United States Patent
Kim et al.

(10) Patent No.: US 12,697,535 B2
(45) Date of Patent: Aug. 4, 2026

(54) HYBRID GOLF SYSTEM AND CONTROL METHOD FOR THE SAME

(71) Applicant: GOLFZON CO., LTD., Seoul (KR)

(72) Inventors: Young Chan Kim, Daejeon (KR); Jae Yoon Ok, Goyang-si (KR); Gwang Seok Jeon, Daejeon (KR)

(73) Assignee: GOLFZON CO., LTD., Seoul (KR)

( * ) Notice: Subject to any disclaimer, the term of this patent is extended or adjusted under 35 U.S.C. 154(b) by 485 days.

(21) Appl. No.: 18/275,436

(22) PCT Filed: Feb. 9, 2022

(86) PCT No.: PCT/KR2022/001955
§ 371 (c)(1),
(2) Date: Aug. 2, 2023

(87) PCT Pub. No.: WO2022/173208
PCT Pub. Date: Aug. 18, 2022

(65) Prior Publication Data

US 2024/0033597 A1 Feb. 1, 2024

(30) Foreign Application Priority Data

Feb. 10, 2021 (KR) ..... 10-2021-0019051

(51) Int. Cl.
*A63B 67/02* (2006.01)
*A63B 57/40* (2015.01)
(Continued)

(52) U.S. Cl.
CPC ..... *A63B 67/02* (2013.01); *A63B 69/3691* (2013.01); *A63B 71/0622* (2013.01); *A63B 57/40* (2015.10); *A63B 2071/0638* (2013.01)

(58) Field of Classification Search
CPC . A63B 67/02; A63B 69/3691; A63B 71/0622; A63B 71/02; A63B 2071/0638
See application file for complete search history.

(56) References Cited

U.S. PATENT DOCUMENTS 10,682,569 B1 * 6/2020 Vale ..... A63B 24/0021
12,370,426 B2 * 7/2025 Ok ..... G06Q 50/10
(Continued)

FOREIGN PATENT DOCUMENTS

KR 10-2002-0092266 A 12/2002
KR 10-2012-0009933 A 2/2012
(Continued)

OTHER PUBLICATIONS

Translation of KR 10-20020092266 (Year: 2002).*
(Continued)

*Primary Examiner* — Christopher R Legendre
(74) *Attorney, Agent, or Firm* — Revolution IP, PLLC

(57) ABSTRACT

A hybrid golf system and control method for the same are configured to further improve the realism of golf play by naturally connecting a virtual golf course on an image projected on a screen and an actual field to naturally convert from a virtual golf play through the virtual golf course image to a field play on the actual field. The hybrid golf system comprises a screen golf module in which a virtual golf play is performed, an actual field on which an actual golf play is performed, and a screen shutter provided on a wall of the screen golf module facing the actual field.

5 Claims, 5 Drawing Sheets

(51) Int. Cl.
*A63B 69/36* (2006.01)
*A63B 71/06* (2006.01)

(56) References Cited

U.S. PATENT DOCUMENTS

| | | | | |
|---|---|---|---|---|
| 2017/0036095 | A1 | 2/2017 | Shultz | |
| 2024/0033597 | A1* | 2/2024 | Kim | A63B 69/3691 |

FOREIGN PATENT DOCUMENTS

| | | | | | |
|---|---|---|---|---|---|
| KR | 10-2012-0036155 | A | | 4/2012 | |
| KR | 10-2012-0036156 | A | | 4/2012 | |
| KR | 10-2013-0030536 | A | | 3/2013 | |
| KR | 10-1337826 | B1 | | 12/2013 | |
| KR | 20190012317 | A | * | 2/2019 | A63B 71/04 |
| KR | 10-2208772 | B1 | | 1/2021 | |

OTHER PUBLICATIONS

Translation of KR 10-1337826 (Year: 2012).*
International Search Report for PCT/KR2022/001955 mailed Aug. 8, 2022 from Korean Intellectual Property Office.

* cited by examiner

HYBRID GOLF SYSTEM AND CONTROL METHOD FOR THE SAME

TECHNICAL FIELD

The present invention is related to a hybrid golf system that in the process of making a virtual golf play using a virtual golf simulation device, if a ball is settled on or around a green on an image of the virtual golf simulation device, allows the user to move to an actual field to take an approach shot around an actual green on an actual field or to putt on the actual green.

BACKGROUND ART

With the recent upsurge in the number of golfers, a so-called screen golf system, which enables a golfer to practice golf and to play a round of virtual golf using a virtual golf simulation apparatus, has gained popularity.

The screen golf system is a system that senses the velocity and direction of a golf ball that a golfer hits onto a screen installed indoors to display a virtual golf course and displays the progress of the golf ball on the screen. The screen golf systems are continuing to evolve in terms of enabling users to feel the same realism that the user feels when playing a round of golf on an actual golf course, which exceeds the level of enjoyment of a golf game that is simply played indoors.

Since a conventional screen golf system implements a simulated image of a virtual golf course and a ball trajectory on the virtual golf course only through a screen installed in front of a user hitting the ball, there is a limit for the user to feel a sense of realism such as playing a golf round at an actual golf course.

To overcome this limitation, so-called a hybrid golf system has been appeared that can be embodied in much smaller space than the actual golf course while providing reality such as playing golf rounds on the actual golf course.

The hybrid golf system combines an actual field that can play actual golf such as a short game with a screen golf system, allowing some of the golf play on a hole to be played on the virtual golf course implemented in the screen golf system, and the rest to be played by playing actual golf on the actual field.

For example, in the case of par 4 hole, a tee shot and a second shot are conducted through the virtual golf simulation on the virtual golf course through the screen golf system, and third shot and putting are allowed to proceed the same as the user moves to the actual field and plays on the actual golf course.

Prior art documents related to the hybrid golf systems include KR10-2013-0030536, KR10-2012-0036155, KR10-2012-0036156, and KR10-2012-0009933.

However, in the conventional hybrid golf system, the user sees an image of the virtual golf course projected on the screen when playing virtual golf, and when playing field, the user moves to the actual field and sees the actual field. At this time, there was a problem that caused users to feel different because the virtual golf course image and the actual field were completely different and felt so different.

That is, there was a problem that the virtual golf play through screen golf and the field play in the actual field were not naturally connected, forcing the user to strongly feel the heterogeneous feeling of playing differently.

Prior Art Documents related to the present invention are as follows:

Korean Patent Publication No. 10-2013-0030536
Korean Patent Publication No. 10-2012-0036155
Korean Patent Publication No. 10-2012-0036156
Korean Patent Publication No. 10-2012-0009933

DISCLOSURE

Technical Problem

The present invention has been made in view of the above problems, and it is an object of the present invention to provide a hybrid golf system and control method for the same that can further improve the realism of golf play by naturally connecting a virtual golf course on an image projected on a screen and an actual field to naturally convert from a virtual golf play through the virtual golf course image to a field play on the actual field.

Technical Solution

In accordance with an aspect of the present invention, the above and other objects can be accomplished by the provision of a hybrid golf system comprising a screen golf module provided on one side of an actual field where a user can play golf and including a virtual golf simulation device that allows the user to play golf on a virtual golf course, and a screen shutter provided in the screen golf module to project an image of the virtual golf course and the virtual golf simulation and configured to open and close a wall of the screen golf module facing the actual field, whereby the virtual golf course is converted into the actual field according to the opening of the screen shutter.

The hybrid golf system may further comprise a screen shutter driver configured to drive opening and closing of the screen shutter, and a controller configured to allow the user to perform a part of golf play in a hole through the virtual golf course in the screen golf module as a virtual golf play and the rest of the golf play in the hole on the actual field as an actual golf play, wherein the controller controls the screen shutter driver to close the screen shutter during the virtual golf play and to open the screen shutter during the actual golf play to connect to the actual field from the inside of the screen golf module.

The actual field may be formed to include a green and a hole-cup for the user to perform an approach shot and a putting, and in the process of playing golf through the virtual golf course in the screen golf module, when the virtual ball is settled within a predetermined range around a green on the virtual golf course, the screen shutter is opened and converted into golf play in the actual field.

The actual field may be formed to include a green and a hole-cup for the user to perform an approach shot and a putting, and in the process of playing golf through the virtual golf course in the screen golf module, when the virtual ball is settled on a green on the virtual golf course, the screen shutter is opened and converted into golf play in the actual field.

In accordance with another aspect of the present invention, there is provided a control method for a hybrid golf system using an actual field provided for a user to play golf and a screen golf module provided on one side of the actual field to play golf on a virtual golf course, the control method comprising processing a virtual golf play in the screen golf module by projecting an image of the virtual golf course on a screen shutter provided on a wall of the screen golf module facing the actual field, and when hitting a ball toward the screen shutter, sensing by a sensing device the hit ball and simulating an image of a virtual ball moving on the virtual golf course, converting from the virtual golf play to an actual golf play on the actual field by opening the screen shutter according to a result of the simulation of the virtual ball in the virtual golf course during the virtual golf play, and processing the actual golf play on the actual field.

The converting from the virtual golf play to an actual golf play on the actual field includes opening the screen shutter when the virtual ball is settled within a predetermined range around a green or settled on the green on the virtual golf course in the process of the virtual golf play in the screen golf module.

Advantageous Effects

A hybrid golf system and control method for the same according to the present invention have effects in that it is possible to further improve the realism of golf play by naturally connecting a virtual golf course on an image projected on a screen and an actual field to naturally convert from a virtual golf play through the virtual golf course image to a field play on the actual field.

DESCRIPTION OF DRAWING

FIG. 3 shows (a) a user playing virtual golf while watching an image projected on a screen shutter inside the screen golf module of the hybrid golf system shown in FIG. 1.

FIG. 3 shows (b) the screen shutter driver opening the screen shutter as field play begins in the virtual golf play process inside the screen golf module.

BEST MODE

A hybrid golf system and a control method thereof according to the present invention will be described in detail with reference to the accompanying drawings.

First, the construction of the hybrid golf system according to an embodiment of the present invention will be described with reference to FIGS. 1 and 2.

Figure 1:
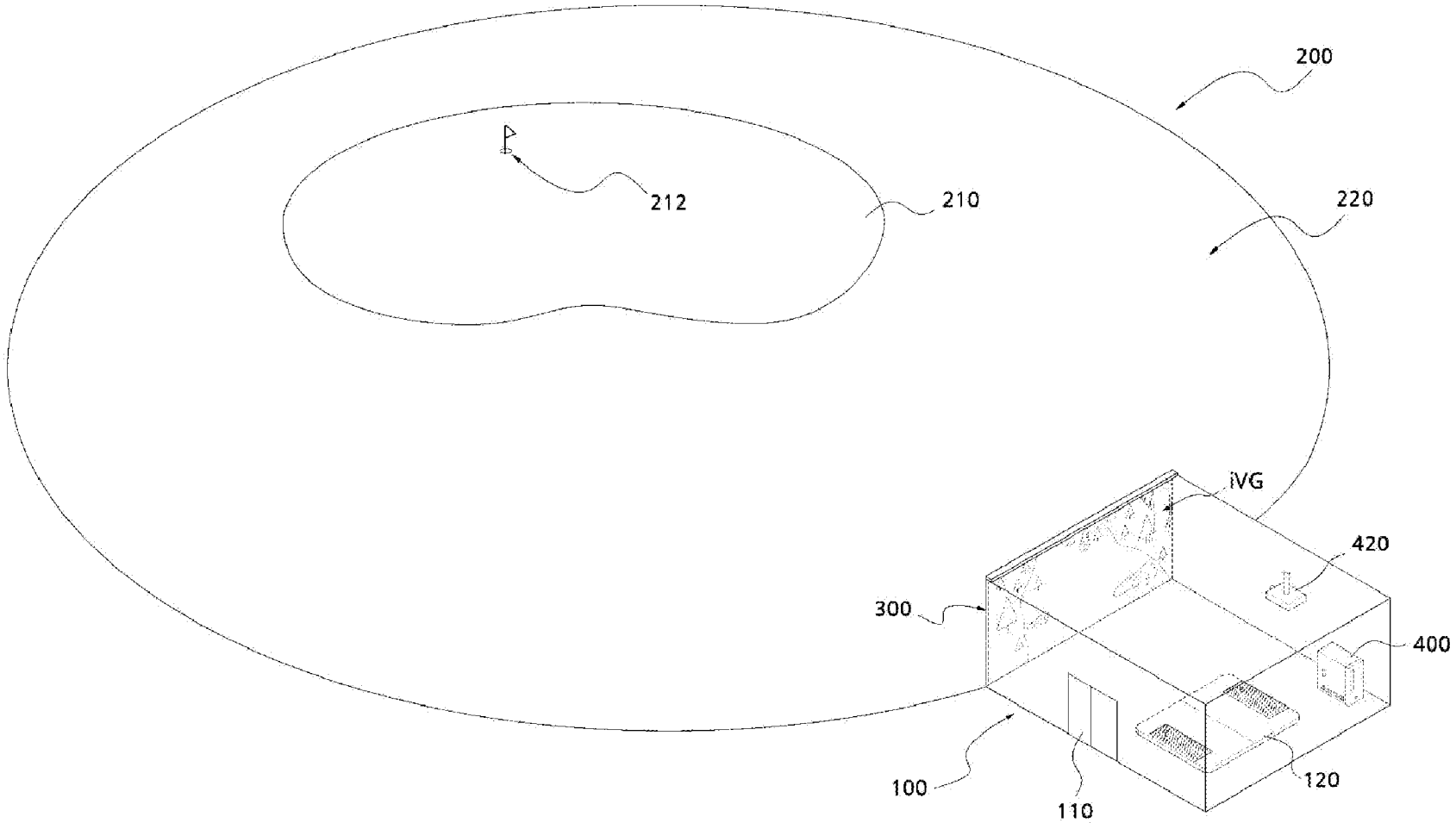
FIG. 1 shows a hybrid golf system according to an embodiment of the present invention.
Figure 2:
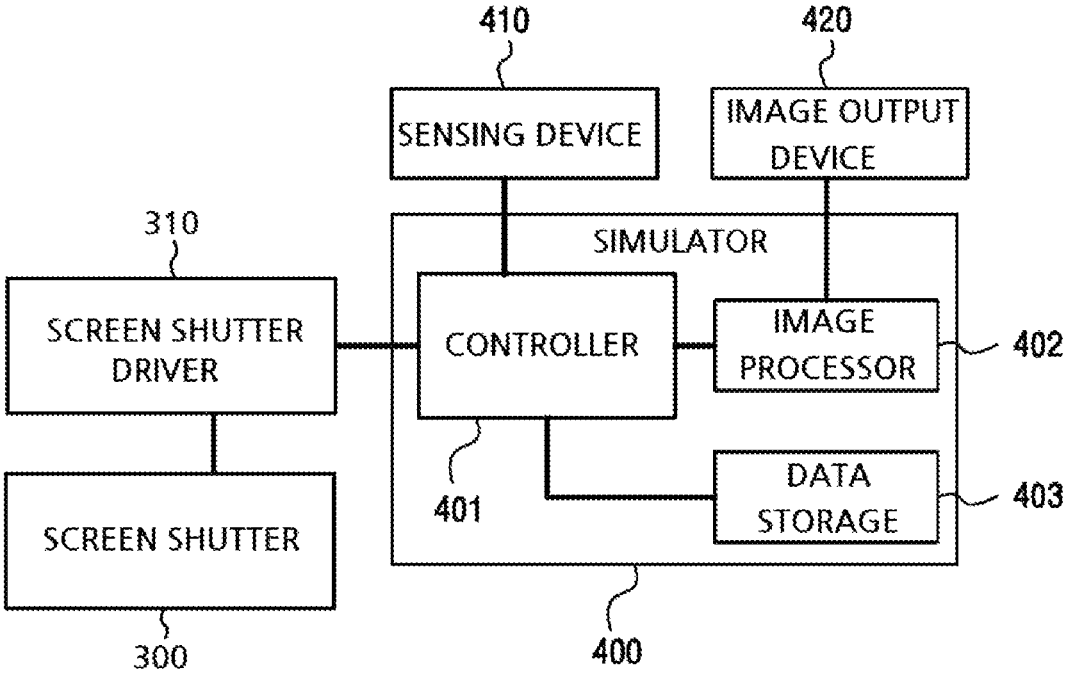
FIG. 2 is a block diagram showing a control system of the hybrid golf system shown in FIG. 1.

FIG. 1 shows a hybrid golf system according to an embodiment of the present invention, and FIG. 2 is a block diagram showing a control system of the hybrid golf system shown in FIG. 1.

As shown in FIG. 1, the hybrid golf system according to an embodiment of the present invention may be configured with an actual field 200 provided for the user to play golf in real and a screen golf module 100 provided with a virtual golf simulation device for the user to play golf on a virtual golf course.

The screen golf module 100 includes a construction related to a conventional screen golf system. Specifically, the screen golf module 100 includes a virtual golf simulation device in which a virtual golf course image is projected on the front screen, when the user hits the ball on a swing stage 120 toward the screen, the sensing device senses the moving ball and a simulation image in which the virtual ball moves on the virtual golf course is provided.

The screen golf module 100 may be provided in the form of a box or a booth with an entrance 110 on one side, and may be in a form in which all walls are closed or some of the walls may be open.

The screen golf module 100 may be configured to include a screen shutter 300 on a wall facing the actual field 200.

The screen shutter 300 is an element that projects an image of a virtual golf course output by an image output device 420 (e.g., a beam projector, etc.) inside the screen golf module 100 and a simulation image iVG on the virtual golf course.

The screen shutter 300 is configured to open and close a wall of the screen golf module 100 facing the actual field 200.

Meanwhile, the actual field 200 may be configured to form a part of the entirety of a hole of the actual golf course, and may be formed to include a green 210 and a hole-cup 212 as shown in FIG. 1. Wherein the actual field 200 may be provided so that the user can approach and putt, including surrounding areas 220 such as a fairway, a rough, and a bunker around the green 210.

In the hybrid golf system according to an embodiment of the present invention, the user performs some golf play through the virtual golf course in the screen golf module 100 and the rest of the golf play is performed in the actual field 200.

In the case of golf play on a par-4 hole, a virtual golf play is performed on the virtual golf course of the par 4 hole in the screen golf module 100, and golf play on the remaining part of the par 4 hole is performed directly on the actual field 200. Wherein the virtual golf play is golf play in which the user takes a golf shot toward the screen shutter at the swing stage and the sensing device senses the hit ball and the simulation of a virtual ball corresponding to the hit ball performs.

For example, the tee shot and the second shot in the par 4 hole are played as the virtual golf play on the virtual golf course in the screen golf module 100, and the third shot (approach shots) and putting can allow the user to move from the screen golf module 100 to the actual field 200 and actually proceed with golf play on the actual field 200.

While the user plays virtual golf in the screen golf module 100, if the user moves out through the door 110 of the screen golf module 100 to the actual field 200 to play field, the user feels a sense of difference rather than a sense of realism, because there is a significant difference between the virtual golf course on the image and the actual field.

The hybrid golf system according to an embodiment of the present invention provides a means and method for minimizing the above-mentioned sense of difference and naturally converting from the virtual golf play in screen golf module to the golf play in actual field.

That is, as shown in FIG. 1, the screen shutter 300 is provided on a wall of the screen golf module 100 facing the actual field 200. The screen shutter 300 plays the same role as a conventional screen by projecting an image by the image output device 420 in the screen golf module 100 during virtual golf play. Then, when field play begins, the screen shutter 300 is opened to provide a view of the actual field 200 spread out in front of the user.

A user who performs virtual golf play inside the screen golf module 100 can naturally convert from the virtual golf course to the actual field as the field play begins and the screen shutter 300 opens while watching the image of the virtual golf course projected on the screen shutter 300. As a user, since the actual field can be viewed through the same view while watching the virtual golf course, a natural connection can be made without feeling different.

As shown in FIG. 2, a controller 401 of the simulator 400 may control the screen shutter driver 310 so that the screen shutter driver 310 may open the screen shutter 300.

As shown in FIGS. 1 and 2, the simulator 400 provided inside the screen golf module 100 includes the controller 401, an image processor 402, and a data storage 403, and the controller 401 may be connected to the sensing device 410 and the screen shutter driver 310.

Figure 3:
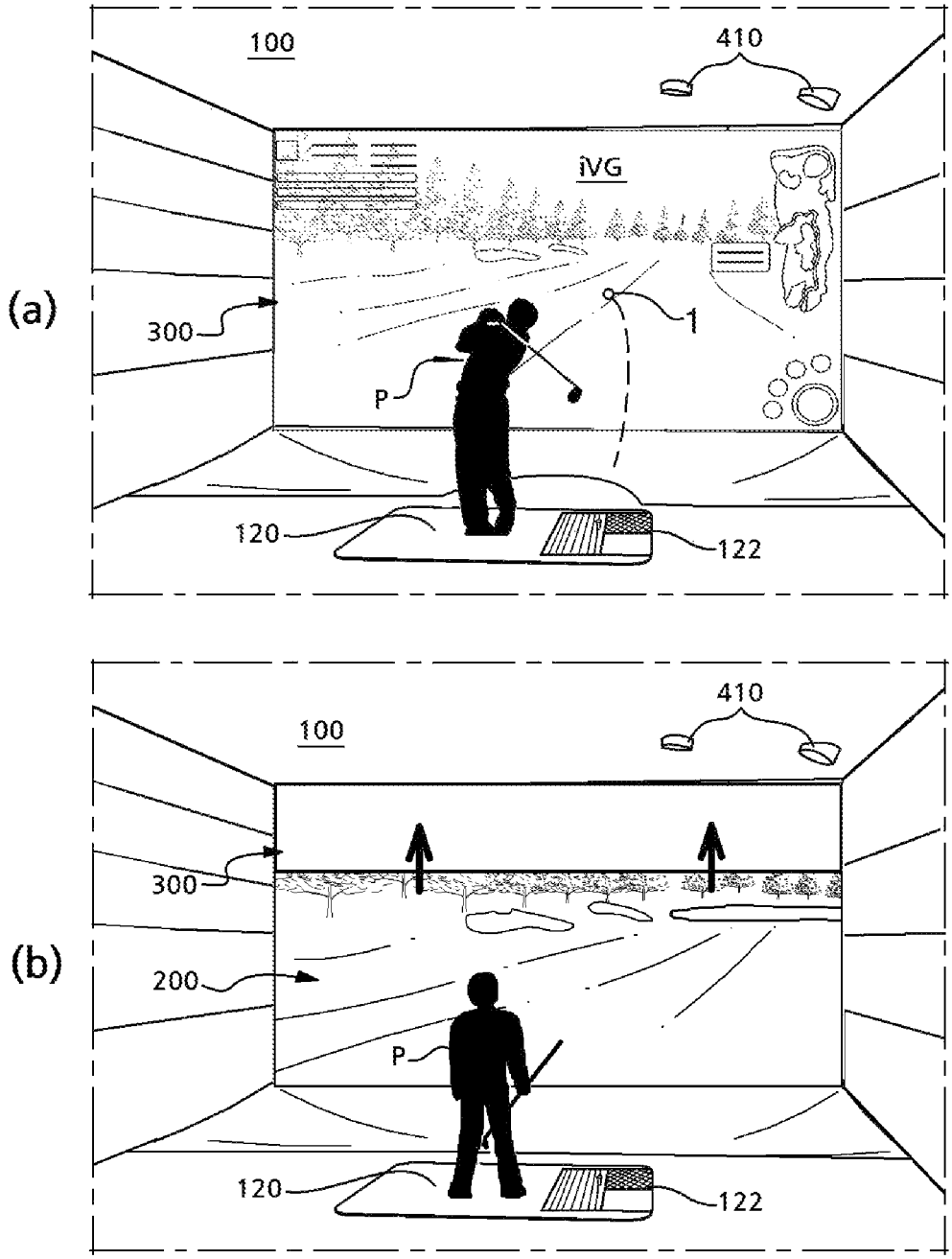
FIG. 3(*a*) shows a user playing virtual golf while watching an image projected on a screen shutter inside the screen golf module of the hybrid golf system shown in FIG. 1.

FIG. 3(*a*) shows that the user (P) plays virtual golf while looking at the image iVG projected on the screen shutter 300 inside the screen golf module 100 shown in FIG. 1.

The sensing device 410 may be embodied as a camera-based device that senses a movement of at least one of a golf club and a ball according to a golf swing of a user. The sensing device 410 captures and collects images of the ball 1 moving as the user P on a swing stage 120 hits the ball placed on a golf mat 122 within the camera's angle of view, performs image processing and analysis on the collected image, calculates sensing information including flight parameters for the movement of the ball 1 and delivers sensing information to the controller 401.

A manipulation device (not shown) may be further provided as a means of manipulating the user to set the environment of the virtual golf simulation or to adjust the aiming during the virtual golf round process.

The data storage 403 stores all data necessary for the image implementation of the virtual golf simulation, and stores data on the virtual golf course and topographic information of the virtual golf course.

The data storage 403 may be configured to store all kinds of data on the virtual golf course, or may be configured to receive and temporarily store various data on the virtual golf course from a server (not shown) through a network.

The image processor 402 performs data processing to implement an image related to the virtual golf course on the screen shutter using data on the virtual golf course stored in the data storage 403, and performs data processing so that the trajectory of the ball hit by the user is simulated on the virtual golf course.

The image information processed by the image processor 402 is projected onto the screen shutter 300 through the image output device 420 (e.g., a projector), allowing the user (P) to see the image (iVG) projected on the screen shutter 300.

The image processor 402 may be implemented as a modular component that performs an image processing function in one independent device, or as an independent device itself.

The controller 401 is in charge of control for all processes for virtual golf simulation. The controller 401 may perform operations and controls to simulate the movement of a virtual ball on a virtual golf course based on sensing information on the movement of the ball extracted according to the sensing result of the sensing device 410 and physics engine. Based on these operations and controls, the controller implements an image iVG in which the virtual ball is simulated on the virtual golf course according to the sensing result of the sensing device and the physics engine.

The controller 401 determines whether a requirement for beginning the field play in the actual field is satisfied in the virtual golf play process in the virtual golf course. If the controller 401 determines that the requirement for beginning the field play have been met, the screen shutter driver 310 can be controlled to open the screen shutter 300.

FIG. 3(*b*) shows that the screen shutter driver 310 opens the screen shutter 300 as the field play begins during the virtual golf play inside the screen golf module 100, and the actual field 200 outside is visible through a space where the screen shutter 300 opens.

The user performs virtual golf play while watching the image iVG of the virtual golf course projected to the screen shutter 300 while the screen shutter 300 is closed as shown in FIG. 3(*a*). Then, the field play begins, and as shown in FIG. 3(*b*), the screen shutter 300 is opened and the actual field 200 appears in the open space, so that the virtual golf course can be naturally converted into the actual field.

Figure 4:
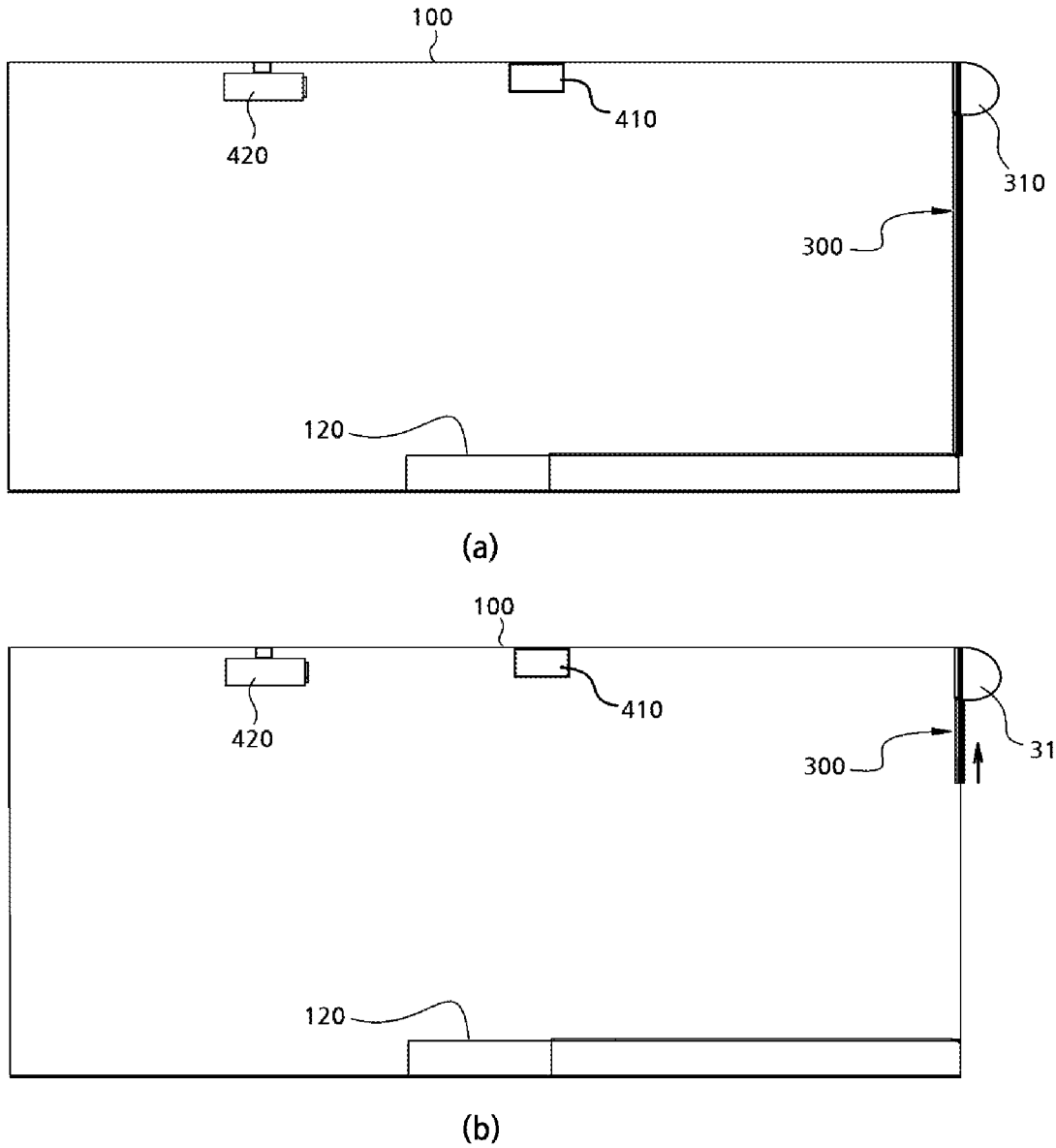
FIG. 4 is a side cross-section of the screen golf module of (a) and (b) of FIG. 3, and (a) of FIG. 4 is a view showing a state in which the screen shutter is closed and (b) of FIG. 4 is a view showing an open state.

FIG. 4 is a side cross-section of the screen golf module of FIG. 3(*a*) and FIG. 3(*b*), and FIG. 4(*a*) is a view showing a state in which the screen shutter is closed and FIG. 4(*b*) is a view showing an open state. In FIGS. 4(*a*) and 4(*b*), the drawing number 120 represents the swing stage, the drawing number 410 represents the sensing device, the drawing number 420 represents the image output device, and the drawing number 310 represents the screen shutter driver, respectively.

As described in FIGS. 4(*a*) and 4(*b*), the opening and closing of the screen shutter 300 may be driven by the screen shutter driver 310 provided on one side of the screen golf module 100.

For example, the screen shutter driver 310 may open the screen shutter 300 in a roll-up manner and close the screen shutter in a roll-down manner.

The screen shutter driver 310 may include a motor provided to wind the screen shutter 300. As the motor of the screen shutter driver 310 winds and rolls up the screen shutter 300, the screen shutter 300 may be opened as shown in FIG. 4(*b*), and on the contrary, as the motor of the screen shutter driver 310 releases and rolls down the screen shutter 300, the screen shutter 300 may be closed as shown in FIG. 4(*a*).

As shown in FIG. 3(*b*) and FIG. 4(*b*), when the screen shutter 300 on which the image of the virtual golf course was projected is opened to see the actual field 200, the user can move to the actual field 200 through the open space of the screen shutter and play golf on the actual field 200.

Meanwhile, a description below is a control method for a hybrid golf system according to an embodiment of the present invention with reference to the flowchart of FIG. 5.

First, as shown in FIG. 1, golf play is performed in the screen golf module 100 as in a conventional screen golf system.

That is, the user selects a virtual golf course to perform virtual golf play, and a virtual golf round at the selected virtual golf course begins (S100).

In the screen golf module 100, an image of the virtual golf course is projected on the screen shutter 300 by the image output device 420, and the user takes a golf shot toward the image-projected virtual golf course, that is, toward the screen shutter, and the sensing device senses the hit ball (S120).

The simulator's controller control to simulate the movement of the virtual ball on the virtual golf course using the sensing results of the sensing device and to project the simulation image on the screen shutter (S130).

In this way, virtual golf play is carried out through the virtual golf course inside the screen golf module, and if the virtual ball lands within a predetermined range around the green on the virtual golf course as a result of the above ball movement simulation (S140), the virtual golf play can be converted into field play in the actual field.

The actual field 200 may be formed to include a green 210, a hole cup 212, and surrounding areas 220 such as a fairway, a rough, and a bunker around the green 210, so that the user can perform an approach shot and a putting. Alternatively, the actual field 200 may be formed to substantially include only the green 210 and the hole cup 212 so that the user can perform a putting.

Figure 5:
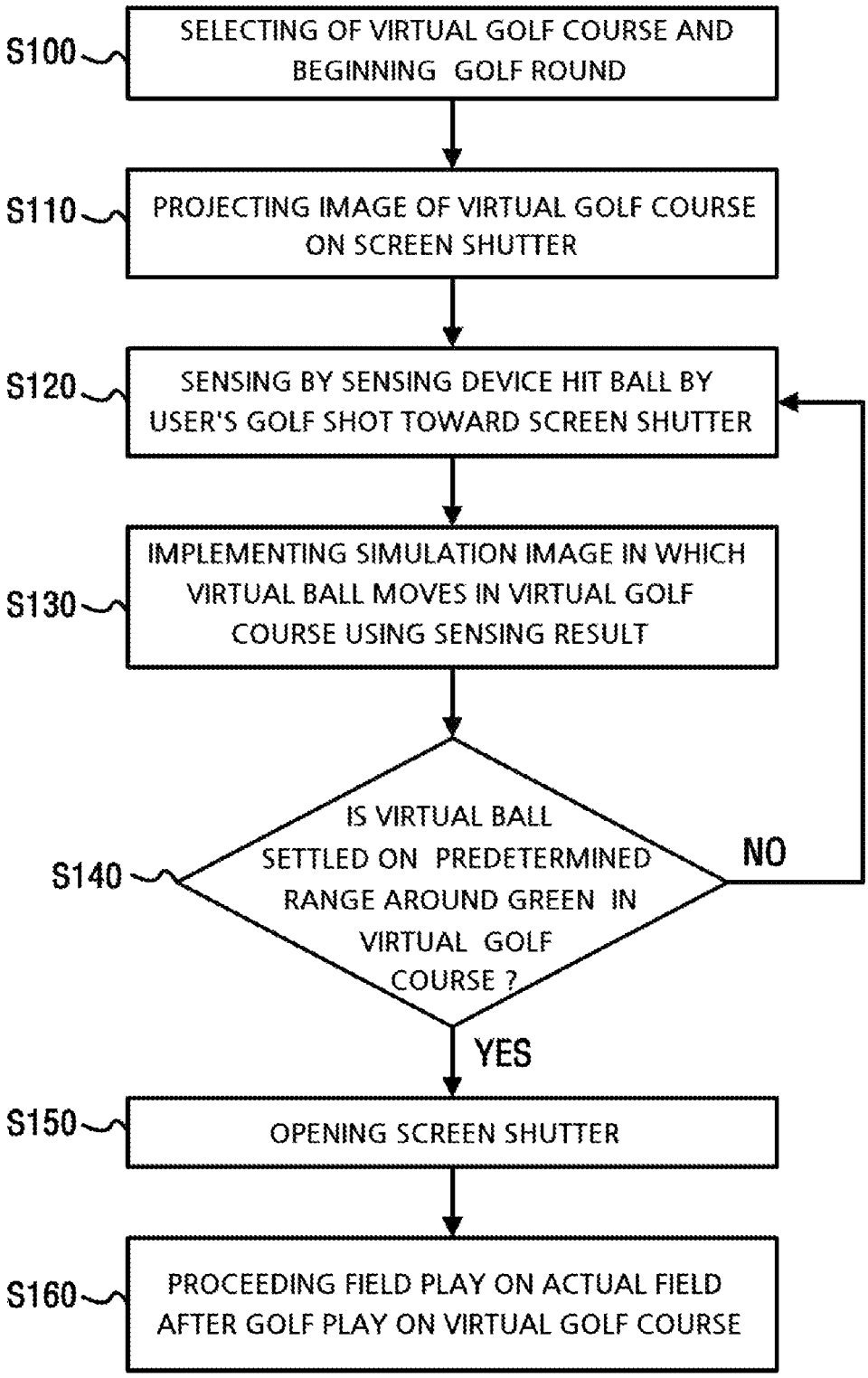
FIG. 5 is a flowchart showing a method of controlling the hybrid golf system according to an embodiment of the present invention.

The step S140 of FIG. 5 may include a case in which a virtual ball is seated within a predetermined range around the green on the virtual golf course or a case in which the virtual ball is seated on the green in the process of playing golf through the virtual golf course in the screen golf module 100.

In the above case, the controller may control the screen shutter driver to open the screen shutter (S150), that is, the screen shutter may be opened as shown in FIG. 3(*b*) and FIG. 4(*b*).

As the screen shutter is opened, the user can see the actual field, and while looking at the actual field, the user can move to the actual field through a space opened the screen shutter and proceed with field play on the actual field (S160).

The method of field play on the actual field can be implemented in various ways, and it is preferable to allow the simulator to record the user's shot numbers in field play in various ways. Accordingly, the simulator can calculate the user's golf score by adding up both the record when the user played through the screen golf module and the record when the user played in the field in the actual field.

As described above, the hybrid golf system and control method for the same according to the present invention have an advantageous effect in that it is possible to further improve the realism of golf play by naturally connecting a virtual golf course on an image projected on a screen and an actual field to naturally convert from a virtual golf play through the virtual golf course image to a field play on the actual field.

INDUSTRIAL APPLICABILITY

A hybrid golf system and control method for the same according to the present invention are applicable to industries related to a golf analysis and industries related to a virtual golf simulation system based on an analysis of the movement of a golf club during golf swing.

The invention claimed is:

1. A hybrid golf system comprising:

a screen golf module provided on one side of an actual field where a user is able to perform actual golf play, the screen golf module including a virtual golf simulation device configured to allow the user to perform virtual golf play on a virtual golf course implemented by the virtual golf simulation device;

a screen shutter provided in the screen golf module, the screen shutter being configured to receive a projected image of the virtual golf course and being configured to open and close a wall of the screen golf module facing the actual field; and a controller configured to control the screen shutter to be closed during the virtual golf play performed in the screen golf module, and, when a requirement to start the actual golf play in the actual field is satisfied according to a position of a virtual ball on the virtual golf course during the virtual golf play, configured to control the screen shutter to be opened so as to convert from the virtual golf play to the actual golf play.

2. The system according to claim 1, wherein the actual field is formed to include a green and a hole-cup for the user to perform an approach shot and a putting, and wherein, in a process of the virtual golf play through the virtual golf course in the screen golf module, when the virtual ball is settled within a predetermined range around a virtual green on the virtual golf course, the controller is configured to control the screen shutter to be opened so as to convert from the virtual golf play to the actual golf play in the actual field.

3. The system according to claim 1, wherein the actual field is formed to include a green and a hole-cup for the user to perform an approach shot and a putting, and wherein, in a process of the virtual golf play through the virtual golf course in the screen golf module, when the virtual ball is settled on a virtual green on the virtual golf course, the controller is configured to control the screen shutter to be opened so as to convert from the virtual golf play to the actual golf play in the actual field.

4. A control method for a hybrid golf system using an actual field provided for a user to perform actual golf play and a screen golf module provided on one side of the actual field for the user to perform virtual golf play on a virtual golf course, the control method comprising:

processing the virtual golf play in the screen golf module by projecting an image of the virtual golf course on a screen shutter provided on a wall of the screen golf module facing the actual field while the screen shutter closes the wall of the screen golf module, sensing, by a sensing device, a ball hit toward the screen shutter, and simulating an image of a virtual ball moving on the virtual golf course;

converting from the virtual golf play to the actual golf play on the actual field by opening the screen shutter when a requirement to start the actual golf play in the actual field is satisfied according to a position of the virtual ball on the virtual golf course during the virtual golf play; and proceeding with the actual golf play on the actual field following the virtual golf play on the virtual golf course.

5. The control method according to claim 4, wherein the actual field is formed to include a green and a hole-cup for the user to perform an approach shot and a putting, and wherein the converting from the virtual golf play to the actual golf play on the actual field includes opening the screen shutter when the virtual ball is settled within a predetermined range around a virtual green on the virtual golf course or when the virtual ball is settled on the virtual green on the virtual golf course during the process of the virtual golf play in the screen golf module.

* * * * *